US006158355A

United States Patent [19]

Zünder

[11] Patent Number: 6,158,355

[45] Date of Patent: Dec. 12, 2000

[54] SAFETY BRACKET FOR MONORAIL SYSTEMS

[75] Inventor: Franz Zünder, Eberndorf, Austria

[73] Assignee: Innovative Transportation Systems International, Inc., Morrison, Colo.

[21] Appl. No.: 09/273,391

[22] Filed: Mar. 22, 1999

[51] Int. Cl.[7] ..... B61B 12/02

[52] U.S. Cl. ..... 104/248; 104/242

[58] Field of Search ..... 104/242, 244.1, 104/93, 89, 248; 105/150, 148, 141

[56] References Cited

U.S. PATENT DOCUMENTS

| | | | |
|---|---|---|---|
| 1,702,091 | 2/1929 | Sellner | 104/248 |
| 5,289,780 | 3/1994 | Bounds | 104/242 |
| 5,715,755 | 2/1998 | Jonischkeit et al. | 104/93 |

*Primary Examiner*—S. Joseph Morano
*Assistant Examiner*—Patrick Craig Muldoon
*Attorney, Agent, or Firm*—Dorr, Carson, Sloan & Birney, P.C.

[57] ABSTRACT

A safety bracket for a vehicle used on a monorail having a top and bottom is disclosed. The vehicle includes a trolley that engages the monorail and propels the vehicle along the monorail. A load portion is attached to the trolley. The load portion can perform predetermined tasks. The safety bracket is connected to the vehicle between the trolley and the load portion. The safety bracket fully supports the vehicle on the monorail when the trolley separates from the monorail. The safety bracket is adapted to move with the trolley and the load portion. The safety bracket includes an attachment piece attached to the vehicle and positioned between the trolley and the load portion. An arm piece is attached to the attachment piece and extends over and above the top of the monorail. The arm piece has an hook section that extends a predetermined distance below the top of the monorail.

20 Claims, 4 Drawing Sheets

Fig. 3
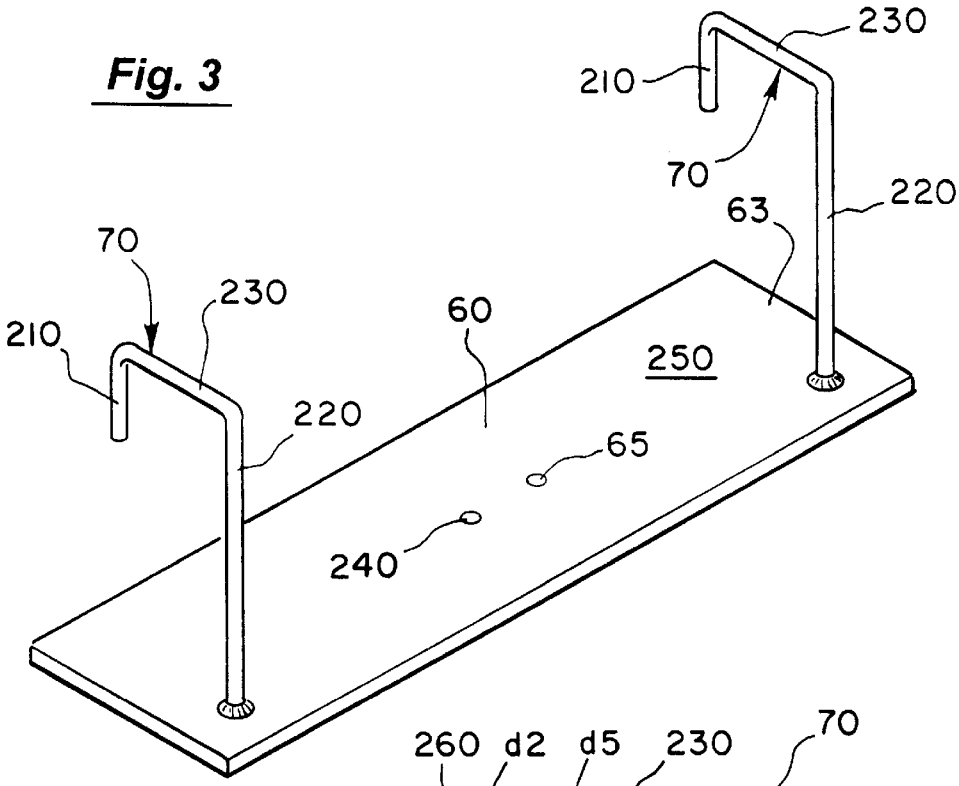
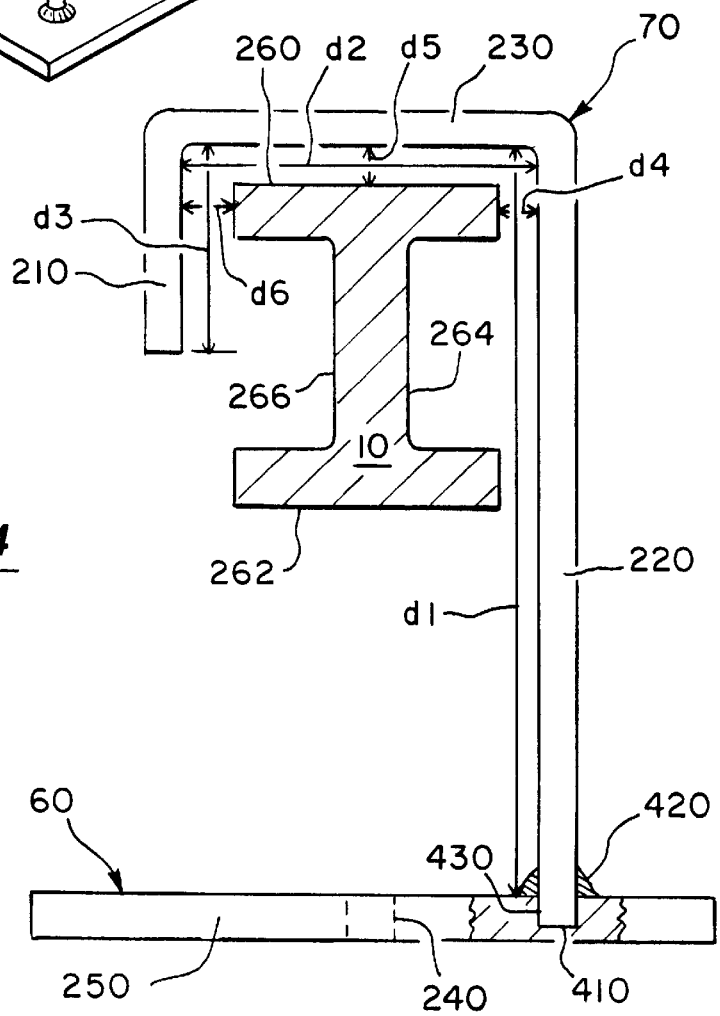
Fig. 4

SAFETY BRACKET FOR MONORAIL SYSTEMS

BACKGROUND OF THE INVENTION

1. Field of the Invention

The present invention relates to a safety bracket for use with monorail systems, and more particularly to a safety bracket that fully supports and retains a vehicle on the monorail without the vehicle becoming fully separated from the monorail.

2. Statement of the Problem

Monorail systems typically include a monorail, a number of vehicles that move along the monorail and electronic control systems that control the movement of the vehicles along the monorail. Typically, the monorail has both straight and curved sections. The monorail is an industry standard aluminum and/or steel rail having an I-type cross section. At the largest dimensions one embodiment of the I-beam has a cross section of about 180 millimeters by 60 millimeters. This dimension allows the monorail (aluminum) to support up to about 1200 kilograms. In most applications, the monorail is installed on overhead support beams or suspended from the ceiling. This overhead configuration allows the vehicles to move along the monorail and perform tasks without being impeded by obstacles located at the floor level.

The electronic control system is used to instruct the vehicle to move along the monorail and to perform predetermined tasks. The electronic control system includes a system controller that communicates with to the vehicles. The system controller is programmed by an operator to instruct the vehicle to move along the monorail and perform predetermined tasks.

The vehicle includes a trolley and a load portion. The trolley includes mechanisms that are used to drive, suspend and align the vehicle on the monorail. However, in an "inverted" monorail configuration, the load portion is positioned above the monorail. In this regard, the trolley includes a motor attached to wheels that drive the vehicle. Typically, the drive wheels contact a top of the monorail. Guide wheels are also connected to the trolley and positioned along the sides of the monorail to align the vehicle on the monorail.

The load portion of the vehicle is attached to the trolley and is typically positioned below the monorail. Further, the load portion is attached to the trolley such that the load portion can pivot with the trolley as the vehicle moves along the monorail. This type of attachment typically includes a shaft that is attached to the load portion and rotatably secured in a pivot hole located in the trolley. This pivoting is desired when the vehicle maneuvers around curved sections of the monorail.

Typically, the trolley is composed of an aluminum alloy casting and is capable of carrying load of over 400 kilograms. These loads induce high stresses and strains on the trolley during operation of the monorail system. From time to time, manufacturing and other problems occur that cause the trolley to become separated from the monorail during operation. In this regard, the vehicle may encounter obstacles on or off the monorail or be maneuvered improperly causing the trolley to become disengaged from the monorail.

In an attempt to prevent the trolley from becoming completely separated from the monorail, conventional systems use a cable to fixedly attached the load portion to the trolley. Therefore, in the event that the shaft connecting the trolley to the load portion fails, the load portion remains connected to the trolley. However, the cable cannot be completely wrapped around the monorail because the cable interfered with movement of the vehicle and with components that are attached to the monorail. Therefore, this technique does not prevent the trolley of the vehicle from becoming completely separated from the monorail.

Therefore, a need exits for a mechanism that prevents the trolley of a vehicle from becoming completely separated from the monorail. Also a need exists for a mechanism that securely supports the vehicle on the monorail if the trolley becomes separated from the monorail.

SUMMARY OF THE INVENTION

1. Solution to the Problem

These and other problems are solved by the present invention. The present invention includes a monorail systems that has a safety bracket that fully supports the vehicle on the monorail when the trolley is separated from the monorail in the event that the trolley fails or the vehicle encounters a problem in maneuvering along the monorail.

2. Summary

In particular, the present invention includes a vehicle for use on a monorail having a top and bottom. The vehicle includes a trolley that engages the monorail to move vehicle along the monorail. A load portion is attached to the trolley. The load portion can perform predetermined tasks.

A safety bracket is connected to the vehicle between the trolley and the load portion. The safety bracket is adapted to fully support the vehicle on the monorail if the trolley becomes separated from the monorail, and the safety bracket is adapted to move with the trolley and the load portion without interfering with the vehicle movement or components connected to the monorail.

The safety bracket includes an attachment piece attached to the vehicle and positioned between the trolley and the load portion. The attachment piece has a longitudinal length with a first end extending beyond one end of the trolley. An arm piece is attached to the attachment piece. The arm piece extends upwardly and over the top of the monorail. The arm piece terminates in an hook section that extends downwardly a predetermined distance below the top of the monorail. In addition, the arm piece is positioned at a predetermined distance above a top portion of the monorail, and the arm piece is positioned a predetermined distance from a first and second side of the monorail.

BRIEF DESCRIPTION OF THE DRAWINGS

FIG. 3 is a perspective view of an embodiment of the safety bracket of the present invention;

FIG. 4 is a cross-sectional view of an embodiment of the safety bracket and the monorail.

DETAILED DESCRIPTION OF THE INVENTION

1. Overview

Figure 1:
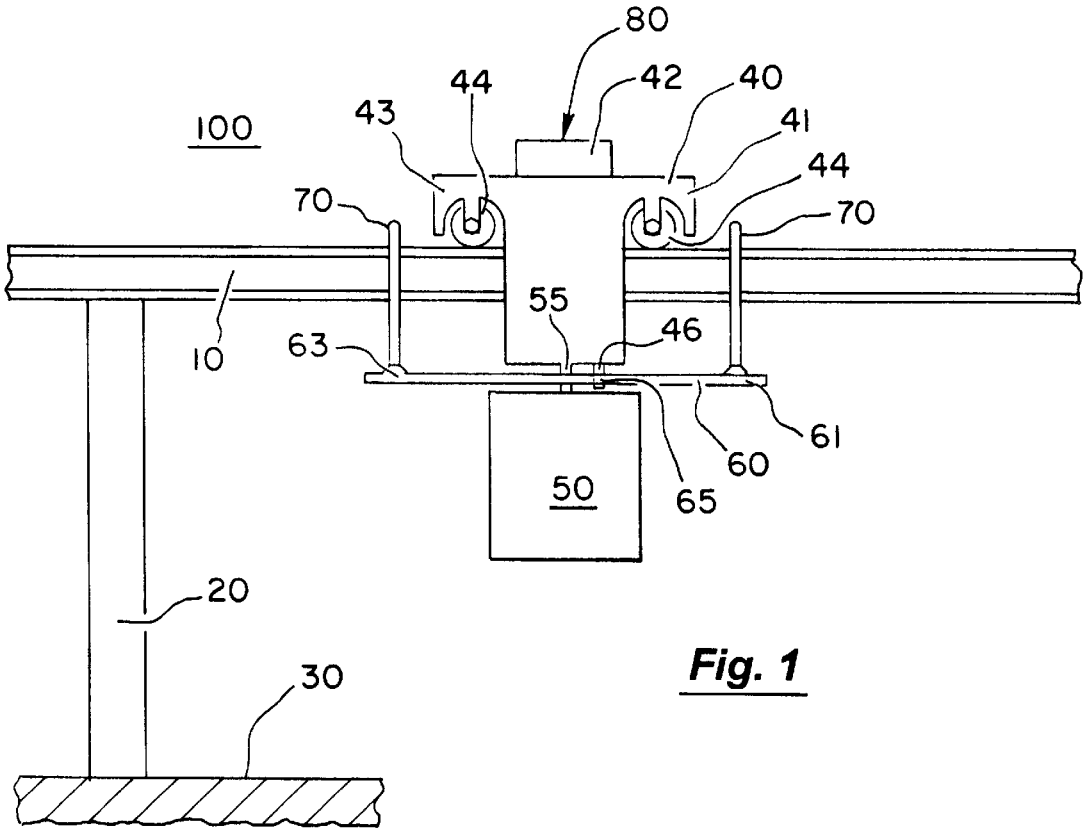
FIG. 1 is a general illustration of the monorail system of the present invention.

The present invention generally relates to a monorail system 100 having a monorail 10 and a number of vehicles 80 that move along the monorail 10. In particular, the present invention relates to a safety bracket 60 used to fully support the vehicle 80 on the monorail 10 when the trolley 40 separates from the monorail 10 in the event of vehicle 80 failure or vehicle 80 maneuvering problems. In FIG. 1, a highly simplified monorail system 100 is illustrated. The monorail system 100 includes a monorail 10 and a number of vehicles 80. The vehicle 80 moves along the monorail 10 and the movement and action of the vehicle 80 are controlled by a control system (not shown). The monorail 10 is supported by a number of support columns 20 that are affixed to a structure 30. The monorail 10 may be installed on a floor surface or suspended from a ceiling depending upon the physical constraints of the building or room in which the monorail system 100 is located. In one embodiment, the monorail 10 is composed of aluminum and has an I-type cross-section.

The vehicle 80 includes a trolley 40 that is connected to a load portion 50 by king bolt 55. The trolley includes drive wheels 44 and guide wheels (not shown) that contact the monorail 10. A motor 42 is provided in the trolley 40 to drive the drive wheels 44. A safety bracket 60 of the present invention having at least one arm 70 is connected to the king bolt 55 between the trolley 40 and the load portion 50. In one embodiment, the pin 46 is attached to an idler wheel (not shown) on the trolley 40 and is positioned in mounting hole 65 located in the safety bracket 60. The positioning of the pin 46 in the mounting hole 65 prevents the safety bracket 60 from rotating by itself and allows the safety bracket 60 to follow the trolley 40 and the load portion 50 as the vehicle 80 moves along the monorail 10. However, any suitable connective device may be used that ensures that the vehicle 80 follows the trolley 40 as the vehicle 80 moves along the monorail 10.

Figure 5:
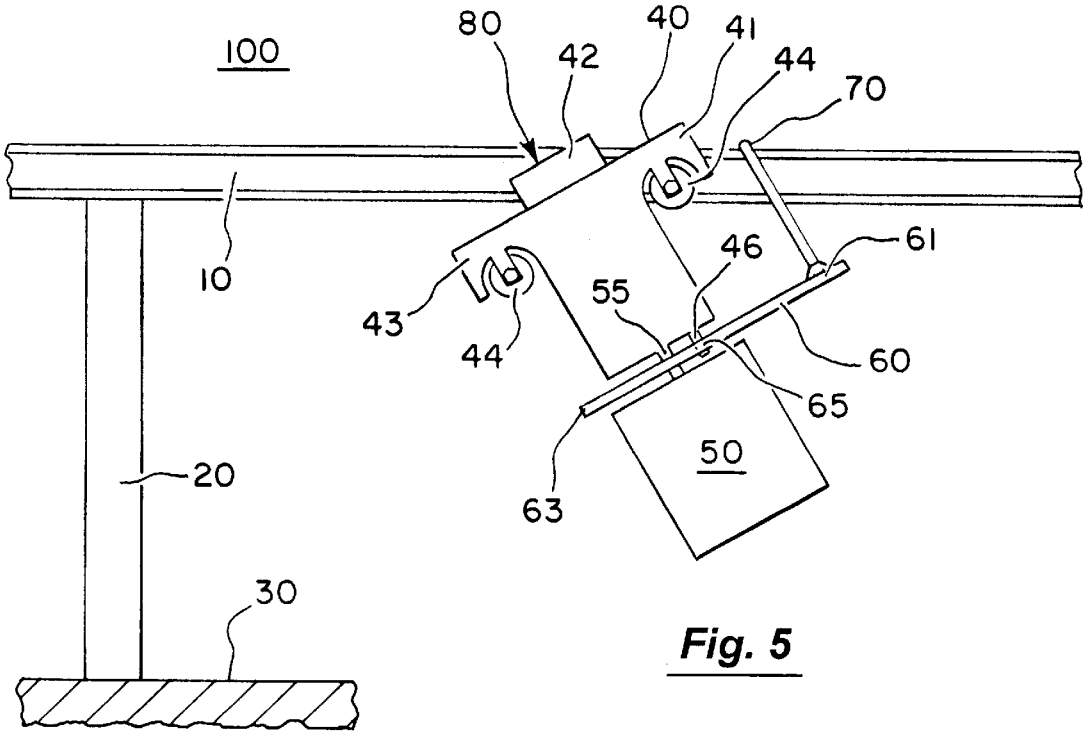
FIG. 5 is a perspective view illustrating the safety bracket holding the vehicle from the monorail after failure of the trolley.
Figure 2:
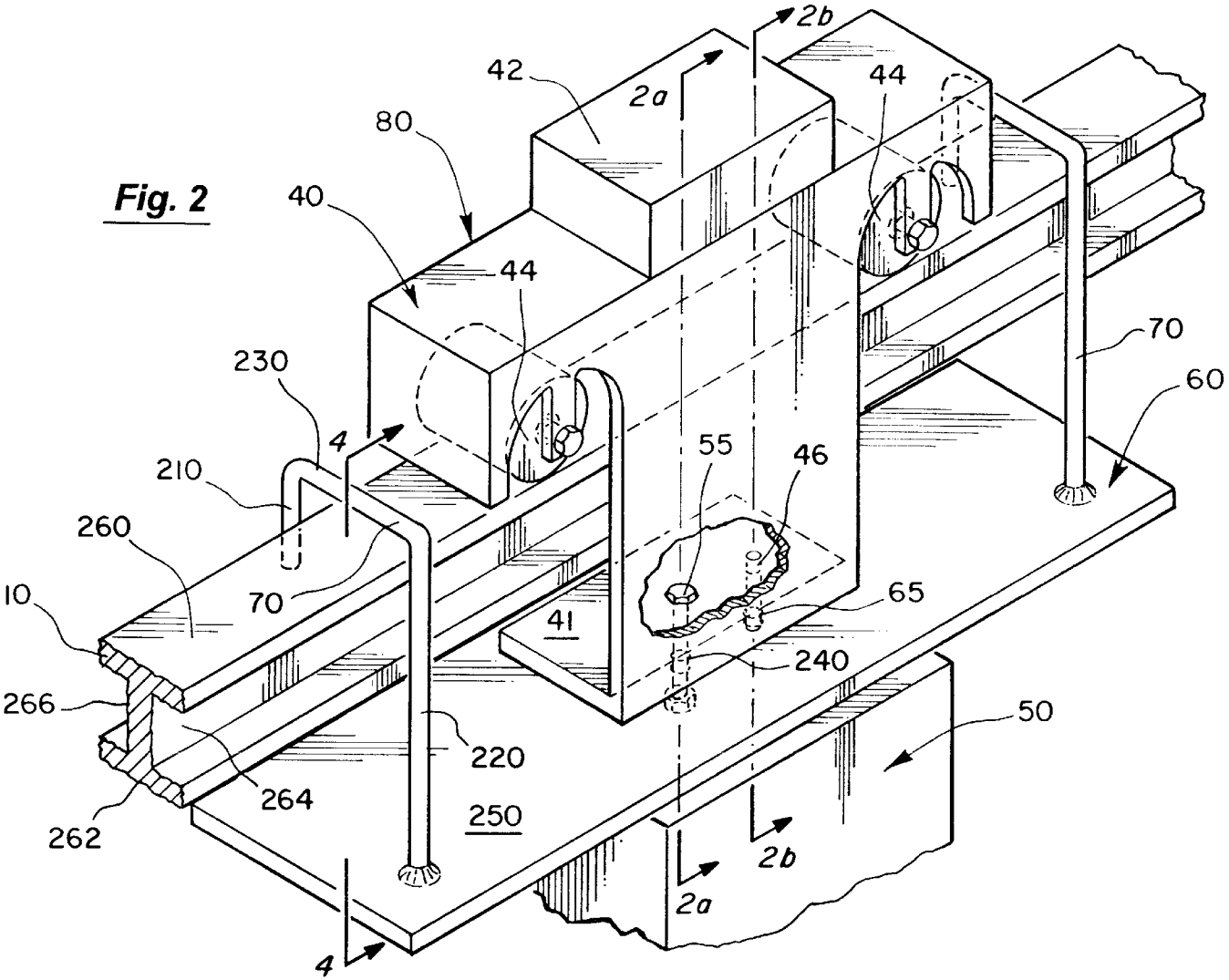
FIG. 2 is a partial perspective view of an embodiment of the trolley of the present invention.

The load portion 50 of the vehicle 80 is connected to king bolt 55 and positioned below the bottom 262 of the monorail 10 and the trolley 40. In FIGS. 1, 2 and 5, the load portion 50 is shown to be positioned below the bottom 262 of the monorail 10. However, it should be appreciated that the load portion 50 can be positioned above the top 260 of the monorail 10 in an "inverted" monorail configuration. Therefore, it is expressly understood that the "inverted" monorail configuration is encompassed under the present invention. The load portion 50 is adapted to carry various desired mechanical or electronic equipment (not shown) used to perform predetermined task. Such equipment is typically controlled by the control system (not shown).

As generally shown in FIG. 1, the safety bracket 60 of the present invention has been disclosed with reference to a monorail system 100. However, it should be appreciated that the present invention can be utilized in many other systems, for example but not limited to, an overhead or ground-based trolley or shuttle system, a suspended crane, a ski chair lift, a gondola or any other device that involves a mechanism that is suspended while it moves along a support system.

2. Safety Bracket

In FIG. 2, the safety bracket 60 is shown having two arms 70 that is connected to a plate 250. As explained above, the safety bracket 60 is positioned between the trolley 40 and the load portion 50. As shown in FIG. 2*a,* the king bolt 55 passes through a hole 240 in the plate 250. The king bolt 55 includes a head 242 that is positioned in a recess 244 located in a plate 41 of trolley 40. The recess 244 has a complementary configuration such that the head 242 is held firmly in the plate 41. In one embodiment, the king bolt 55 is about 6 inches in length. The king bolt 55 passes through a hole 240 that is located in plate 250 of the safety bracket 60, and the king bolt connects to a fastener 246 to firmly secure the plate 250 between plate 41 and load portion 50.

Figure 2B:
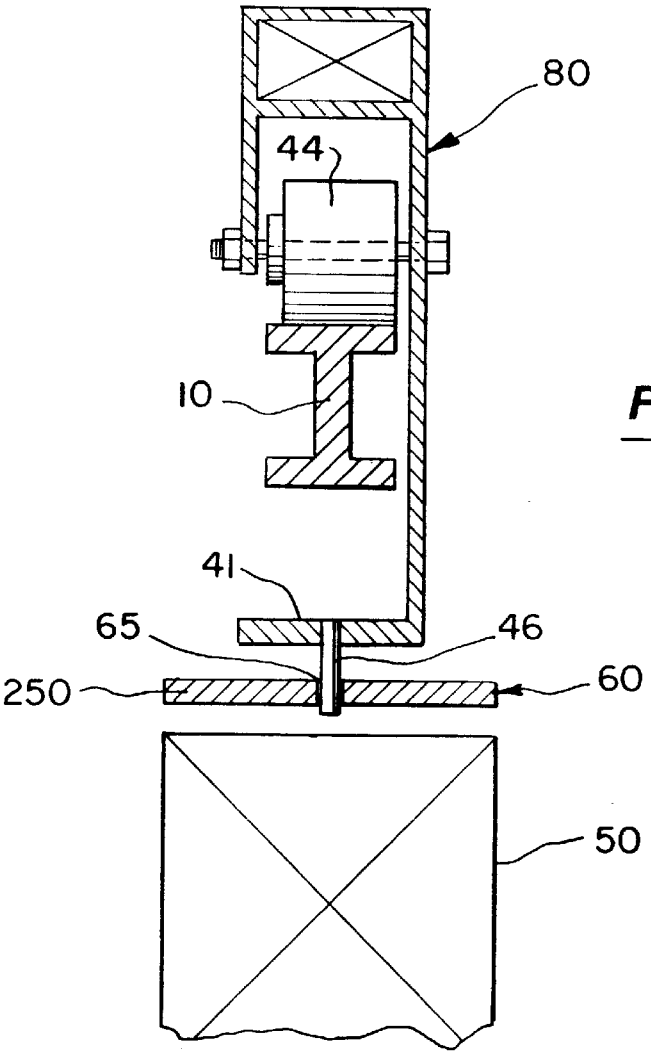
FIG. 2*b* a second cross-sectional view of the trolley of the present invention.
Figure 2A:
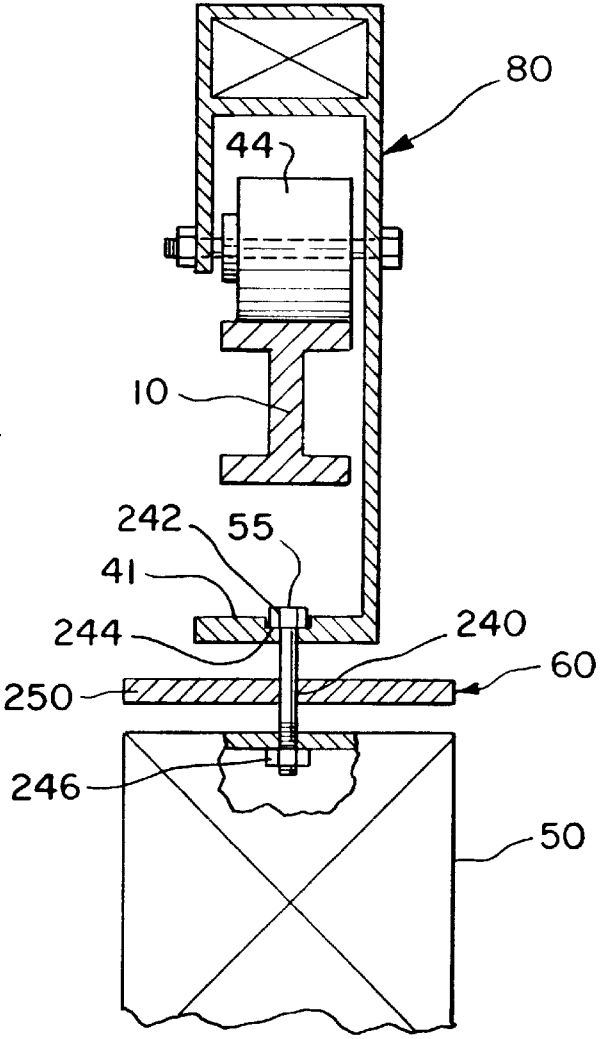
FIG. 2*a* is a first cross-sectional view of the trolley of the present invention.

As shown in FIG. 2*b,* the safety bracket 60 also includes at least one formed mounting hole 65 in plate 250. The formed mounting hole 65 accepts pin 46 that is connected to the trolley 40, such as, for example to an idler wheel (not shown). The connection between the formed mounting hole 65 and the pin 46 assures that the safety bracket 60 moves with the vehicle 80 as the vehicle 80 maneuvers on the monorail 10. It should be appreciated that safety bracket 60 can have additional formed holes (not shown) similar to formed hole 65 located in plate 250. These additional formed holes (not shown) can be used for mounting purposes (as described with mounting hole 65) or the additional formed holes (not shown) can be present to ensure that the safety bracket 60 fits properly against the trolley 40. In this regard, the trolley 40 can have components (not shown) that can contact the safety bracket 60 and cause misalignment of the safety bracket 60. The additional formed holes (not shown) can be placed in the plate 250 to accommodate and/or receive a portion of these components such that the safety bracket 60 properly connects between the trolley 40 and the load portion 50.

In FIGS. 2 and 3, the safety bracket 60 consists of the arm 70 and the plate 250 to which arm 70 is connected. It should be appreciated that the present invention could include, as shown in FIG. 1, more than one safety arm 70 as part of the safety bracket 60. Further, the present invention, as shown in FIG. 1, should not be limited to two arms 70, and the present invention should be construed to expressly embody a safety bracket 60 having several arms 70 depending on design requirements.

As shown in FIGS. 1, 3 and 5, plate 250 extends longitudinally to a first end 61 and a second end 63. In one embodiment, as shown in FIG. 1, the first and second ends 61 and 63 extend beyond ends 41 and 43 of the trolley 40. Further, arms 70 are connected to first and second ends 61 and 63 of plate 250 that extend beyond ends 41 and 43 of trolley 40. In another embodiment, as shown in FIG. 5, the first end 61 of plate 250 extends beyond end 41 of the trolley 40 while the second end 63 does not extend beyond end 43 of trolley 40. In this embodiment, arm 70 is attached to only the first end 61 of plate 250 that extends beyond end 41 of trolley 40. The positioning of the first and second ends 61 and 63 affects the positioning arm 70, for example, extending the arms 70 beyond the ends 41 and 43 of trolley 40. When the arms 70 are placed beyond the ends 41 and 43 of vehicle 80, the arms 70 do not interfere with the movement of the trolley 40, for example, the movement of wheels 44.

The arm 70 includes a riser section 220 as shown in FIG. 2, a horizontal section 230 and an hook section 210. Typically, the arm 70 is formed from a single piece of material. However, it should be appreciated that the arm 70 could be composed of separate pieces that are connected together. The riser section 220 is connected to the plate 250 and extends upwardly on a first side 264 of the monorail 10 from a position below the bottom 262 of the monorail 10 to a position above a top 260 of the monorail 10. The horizontal section 230 is connected to the riser section 220 and extends above, over and across the top 260 the monorail 10 from the first side 264 to the second side 266. The hook section 210 is connected to the horizontal section 230 and extends downwardly from a point above the top 260 of the monorail 10 along the second side 266 to a predetermined distance below the top 260 of the monorail 10.

In FIG. 4, the riser section 220 of the arm 70 has an end 430 that is located in a positioning hole 410 in plate 250. In this embodiment, the positioning hole 410 does not pass completely through the plate 250. However, in other embodiments the positioning hole 410 may pass completely through plate 250. The riser section 220 is welded into positioning hole 410 by welding material 420. It should be appreciated that the arm 70 may be connected to the plate 250 by techniques other than welding.

In a preferred embodiment, the riser section 220 of the arm piece 70 extends upwardly along the first side 264 of the monorail 10 from below the bottom 262 of the monorail 10 to above the top 260 of the monorail 10. As shown in FIG. 4 the riser section 220 has a length $d_1$ and is located a distance $d_4$ from the first side 264 of the monorail 10. The horizontal section 230 has a length $d_2$ and is located a distance of $d_5$ from a top 260 of the monorail 10. The hook section 210 has a length of $d_3$ and is located a distance $d_6$ from the second side 266 of the monorail 10. The riser section 220 extends a distance ($d_1$) of about 250 millimeters (±10%) above the plate 250 that is located below a bottom 262 of the monorail 10. The horizontal section 230 extends from the first side 264 to the second side 266 above the top 260 of the monorail 10. The horizontal section 230 extends a distance ($d_2$) of about 90 millimeters across the top 260 of the monorail 10. The horizontal section 230 is positioned above the top 260 of the monorail 10 by a distance ($d_5$) ranging from about 10 to 30 millimeters. The hook section 210 extends from above the top 260 of the monorail 10 along the second side 262 of the monorail 10 and terminates at a predetermined distance between the top 230 and the bottom 262 of the monorail 10. In one embodiment, the hook section 230 extends a distance ($d_3$) of about 50 millimeters from said horizontal section. Therefore, in one embodiment, the hook section 230 extends a distance ($d_3$) ranging from about 20 to 40 millimeters from the top 260 of the monorail 10. It should be noted that the hook section 210 must extend a predetermined distance below the top 260 of the monorail 10 such that the hook section 260 can make contact with the second side 262 of the monorail 10 when the vehicle 80 becomes disengaged from the monorail 10. In another embodiment, the distances ($d_4$, $d_5$, and $d_6$) between the safety bracket 70 and the monorail 10 range from about 10 to 30 millimeters. In addition, the length $d_3$ of hook section 210 ranges from 15% to 25% of the length $d_1$ of riser section 220. Further, it should be appreciated that the distances, ranges, and described above are for illustrative purposes only, and the embodiment described is not intended to limit the present invention to those dimensions disclosed. As such, the present invention expressly encompasses embodiments having different dimensions.

In a preferred embodiment, the plate 250 of the safety bracket 60 has a rectangular shape. Further, the dimensions of the plate 250 have a thickness of about 10 millimeters, a width of about 110 millimeters and a length of about 240 millimeters. Additionally, in a preferred embodiment, the arm 70 is single piece of material having a cylindrical shape with a radius of about 10 millimeters. It should be noted that these dimensions are descriptive of one embodiment of the present invention and that this disclosure expressly encompasses dimensions other than those disclosed herein.

3. Safety Bracket Function

As shown in FIG. 5, the safety bracket 70 is adapted to fully support the vehicle 80 on the monorail 10 when the trolley 40 becomes separated from the monorail 10 in the event of problems or due to manufacturing defects. The vehicle 80 can become separated from the monorail 10 for several reasons. For example, the trolley 40 can fail causing the vehicle 80 to separate from the monorail 10. In this regard, the trolley 40 is typically composed of cast aluminum or aluminum alloy. If impurities are present in the metal or alloy during casting, the material can become brittle and the trolley 40 can fail under loads carried by the load portion 50.

In addition, the trolley 40 of vehicle 10 may encounter maneuverability problems that cause the trolley 40 to become separated from the monorail 10. For example, the vehicle 80 may encounter obstacles on the monorail 10 or at the ground level that disengage the trolley 40 from the monorail 10. Additionally, the vehicle 80 can move in certain manner that causes the trolley 80 to become detached from the monorail 10. For example, the vehicle 80 can travel at too high of a speed around a corner of the monorail 10 and as a result become detached from the monorail 10. In any event, the safety bracket 80 prevents the vehicle 80 from becoming completely separated from the monorail 10.

Since the safety bracket 80 must be capable of supporting the full weight of the vehicle 80. Therefore, the safety bracket 80 must be composed of a material that is capable of holding at least 800 kilograms or more. In one embodiment, the safety bracket 80 is composed of a steel alloy and more preferably a S252 steel alloy which is commercially available. Regardless, the safety bracket 80 should be composed of a material that has at least an equal or a higher strength than the material of the trolley 40.

The foregoing discussion of the invention has been presented for purposes of illustration and description. Further, the description is not intended to limit the invention to the form disclosed herein. Consequently, variation and modification commensurate with the above teachings, within the skill and knowledge of the relevant art, are within the scope of the present invention. The embodiment described herein and above is further intended to explain the best mode presently known of practicing the invention and to enable others skilled in the art to utilize the invention as such, or in other embodiments, and with the various modifications required by their particular application or uses of the invention. It is intended that the appended claims be construed to include alternate embodiments to the extent permitted by the prior art.

What is claimed is:

1. A vehicle for use on a monorail, said monorail having a top and bottom, said vehicle comprising:

a trolley adapted to engage said monorail to move said vehicle along said monorail;

a load portion attached to said trolley, said load portion performing predetermined tasks; and a safety bracket connected to said vehicle, said safety bracket adapted to fully support and hold said vehicle when said trolley separates from said monorail wherein said safety bracket is adapted to move with said trolley and said load portion, said safety bracket comprising:

an attachment piece attached to said vehicle and positioned between said trolley and said load portion, said attachment piece having a longitudinal length with a first end extending beyond one end of said trolley; and an arm piece connected to said first end of said attachment piece, said arm piece adapted to extend upwardly and over said top of said monorail, said arm piece terminating in a hook section adapted to extend downwardly a predetermined distance below said top of said monorail.

2. The vehicle, as claimed in claim 1, wherein said safety bracket is composed of a steel alloy.

3. The vehicle, as claimed in claim 1, wherein said safety bracket is composed of an S252 steel alloy.

4. The vehicle, as claimed in claim 1, wherein said arm piece has a cylindrical shape.

5. The vehicle, as claimed in claim 4, wherein said cylindrical shape has a radius of substantially 10 millimeters.

6. The vehicle, as claimed in claim 1, wherein said attachment piece further comprises a formed hole to accept said arm piece, said arm piece being welded in said formed hole to said attachment piece.

7. The vehicle, as claimed in claim 1, wherein said attachment piece further comprises at least one formed hole corresponding to at least one bolt on said trolley, said at least one formed hole accepting said at least one bolt for assuring said safety bracket moves with said trolley and said load portion.

8. The vehicle, as claimed in claim 1, wherein said attachment plate has a rectangular shape.

9. The vehicle, as claimed in claim 1, wherein said attachment plate has dimensions of a length of about 240 millimeters and a width of substantially 110 millimeters and a thickness of substantially 10 millimeters.

10. The vehicle, as claimed in claim 1, wherein said arm piece extends above said attachment piece by substantially 250 millimeters.

11. The vehicle, as claimed in claim 1, wherein said arm piece adapted to extend across said top of said monorail by substantially 90 millimeters.

12. The vehicle, as claimed in claim 1, wherein said hook section adapted to extend substantially 50 millimeters below said top of said monorail.

13. The vehicle, as claimed in claim 1, wherein said arm piece adapted to extend above said top of said monorail by a distance in a range of substantially 10 to 30 millimeters.

14. A vehicle for use on a monorail, said monorail having a top and bottom, said vehicle comprising:

a trolley adapted to engage said monorail to move said vehicle along said monorail;

a load portion attached to said trolley, said load portion performing predetermined tasks; and a safety bracket connected to said vehicle between said trolley and said load portion, said safety bracket adapted to fully support and hold said vehicle when said trolley separates from said monorail.

15. The vehicle, as claimed in claim 14, wherein said safety bracket comprises:

an attachment piece attached to said vehicle and positioned between said trolley and said load portion; and an arm piece attached to said attachment piece, said arm piece adapted to extend upwardly and above said top of said monorail, said arm piece having a hook section adapted to extend downwardly a predetermined distance below said top of said monorail.

16. The vehicle, as claimed in claim 15, wherein said arm piece includes a riser section extending upwardly from said attachment piece and a horizontal section adapted to extend above said top of said monorail and connected to said riser section and said hook section, said hook section having a length being ranging from substantially 15% to 20% of a length of said riser section.

17. The vehicle, as claimed in claim 14, wherein said safety bracket is adapted to move with said trolley and said load portion.

18. A monorail system comprising:

a monorail having a top and bottom; and at least one vehicle on said monorail, said at least one vehicle comprising:

a trolley engaging said monorail to move said vehicle along said monorail;

a load portion attached to said trolley, said load portion performing predetermined tasks; and a safety bracket connected to said at least one vehicle and positioned between said trolley and said load portion, said safety bracket fully supporting said at least one vehicle on said monorail when said trolley separates from said monorail.

19. The monorail system, as claimed in claim 18, wherein said safety bracket further comprises:

an attachment piece attached to said vehicle and positioned between said trolley and said load portion, said attachment piece having a longitudinal length with a first end extending beyond one end of said trolley; and an arm piece connected to said first end of said attachment piece, said arm piece extending upwardly and over said top of said monorail, said arm piece terminating in a hook section extending downwardly a predetermined distance below said top of said monorail.

20. The monorail system, as claimed in claim 19, wherein said attachment piece further comprises at least one formed hole corresponding to at least one bolt on said trolley, said at least one formed hole accepting said at least one bolt for assuring said safety bracket moves with said trolley and said load portion.

* * * * *